US011460792B2

(12) United States Patent
Kainuma

(10) Patent No.: US 11,460,792 B2
(45) Date of Patent: Oct. 4, 2022

(54) INTERMEDIATE TRANSFER DEVICE AND IMAGE FORMING APPARATUS

(71) Applicant: KYOCERA Document Solutions Inc., Osaka (JP)

(72) Inventor: Takashi Kainuma, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/579,450

(22) Filed: Jan. 19, 2022

(65) Prior Publication Data

US 2022/0236668 A1 Jul. 28, 2022

(30) Foreign Application Priority Data

Jan. 22, 2021 (JP) ..... JP2021-008394

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1605; G03G 15/1615; G03G 15/1625
USPC ..... 399/298, 299, 302, 308
See application file for complete search history.

(56) References Cited

U.S. PATENT DOCUMENTS

| | | | | |
|---|---|---|---|---|
| 6,324,374 | B1 | 11/2001 | Sasamoto et al. | 399/298 |
| 7,062,209 | B2 * | 6/2006 | Murakami et al. | G03G 15/0136 399/299 |
| 9,217,945 | B2 * | 12/2015 | Hosohara et al. | G03G 15/1615 |
| 10,775,717 | B2 * | 9/2020 | Kouzu | G03G 15/1615 |
| 2002/0044799 | A1 | 4/2002 | Sasamoto et al. | 399/298 |
| 2003/0185602 | A1 | 10/2003 | Sasamoto et al. | 399/299 |
| 2004/0213605 | A1 | 10/2004 | Sasamoto et al. | 399/299 |
| 2005/0244197 | A1 | 11/2005 | Sasamoto et al. | 399/299 |

FOREIGN PATENT DOCUMENTS

JP 2007-108788 A 4/2007

* cited by examiner

*Primary Examiner* — William J Royer
(74) *Attorney, Agent, or Firm* — Stein IP, LLC

(57) ABSTRACT

An intermediate transfer device includes an intermediate transfer belt, a plurality of primary transfer rollers, a plurality of pairs of support members, a biasing member, a pair of movable members, and a pair of frame members. The plurality of pairs of support members rotatably support both end parts of respective rotary shafts of the plurality of primary transfer rollers and are pivotable in directions in which the primary transfer rollers approach and separate from the intermediate transfer belt. The pair of movable members makes contact with the support members on both end sides of the rotary shafts of the plurality of primary transfer rollers so as to cause the support members to pivot. In a rotation axis direction of the primary transfer rollers, the movable members are disposed between the pair of frame members and within an extending range of the intermediate transfer belt.

5 Claims, 6 Drawing Sheets

INTERMEDIATE TRANSFER DEVICE AND IMAGE FORMING APPARATUS

INCORPORATION BY REFERENCE

This application is based upon and claims the benefit of priority from the corresponding Japanese Patent Application No. 2021-008394 filed on Jan. 22, 2021, the contents of which are incorporated herein by reference.

BACKGROUND

The present disclosure relates to an intermediate transfer device including an endless intermediate transfer belt and to an image forming apparatus.

As an electrophotographic image forming apparatus such as a copy machine or a printer, there is known an intermediate transfer-type image forming apparatus in which toner images of different colors formed on respective outer circumferential surfaces of a plurality of photosensitive drums (image carriers) are primarily transferred sequentially in a superimposed manner to an endless intermediate transfer belt disposed along the plurality of photosensitive drums, and then the toner images are secondarily transferred to a sheet.

For example, a conventional image forming apparatus includes an intermediate transfer belt that is supported by a plurality of support rollers, a plurality of photosensitive drums that are arranged side by side in opposed contact with the intermediate transfer belt, and a pivot mechanism that separates, from each other, the intermediate transfer belt and some of the photosensitive drums so that they are positioned apart from each other. Since the intermediate transfer belt and some of the photosensitive drums are separated from each other by the pivot mechanism, it is possible to prevent problems such as a service life of the photosensitive drums being reduced due to unnecessary contact and proximity between the intermediate transfer belt and the photosensitive drums and scattering and waste of a developer.

SUMMARY

An intermediate transfer device according to one aspect of the present disclosure includes an intermediate transfer belt, a plurality of primary transfer rollers, a plurality of pairs of support members, a biasing member, a pair of movable members, and a pair of frame members. The intermediate transfer belt is endless and moves along an arrangement direction of a plurality of image carriers. The plurality of primary transfer rollers are disposed to be opposed to the plurality of image carriers via the intermediate transfer belt and transfer toner images formed on respective outer circumferential surfaces of the plurality of image carriers sequentially in a superimposed manner onto the intermediate transfer belt. The plurality of pairs of support members rotatably support both end parts of respective rotary shafts of the plurality of primary transfer rollers and are pivotable in directions in which the primary transfer rollers approach and separate from the intermediate transfer belt. The biasing member biases each of the support members in the direction in which the primary transfer rollers approach the intermediate transfer belt. The pair of movable members makes contact with the support members on both end sides of the rotary shafts of the plurality of primary transfer rollers so as to cause the support members to pivot. The pair of frame members is disposed at the both end parts of the rotary shafts of the plurality of primary transfer rollers and pivotably supports the support members. Moreover, in a rotation axis direction of the primary transfer rollers, the movable members are disposed between the pair of frame members and within an extending range of the intermediate transfer belt.

DETAILED DESCRIPTION

With reference to the appended drawings, the following describes an embodiment of the present disclosure. The present disclosure, however, is not limited to a configuration described below.

Figure 1:
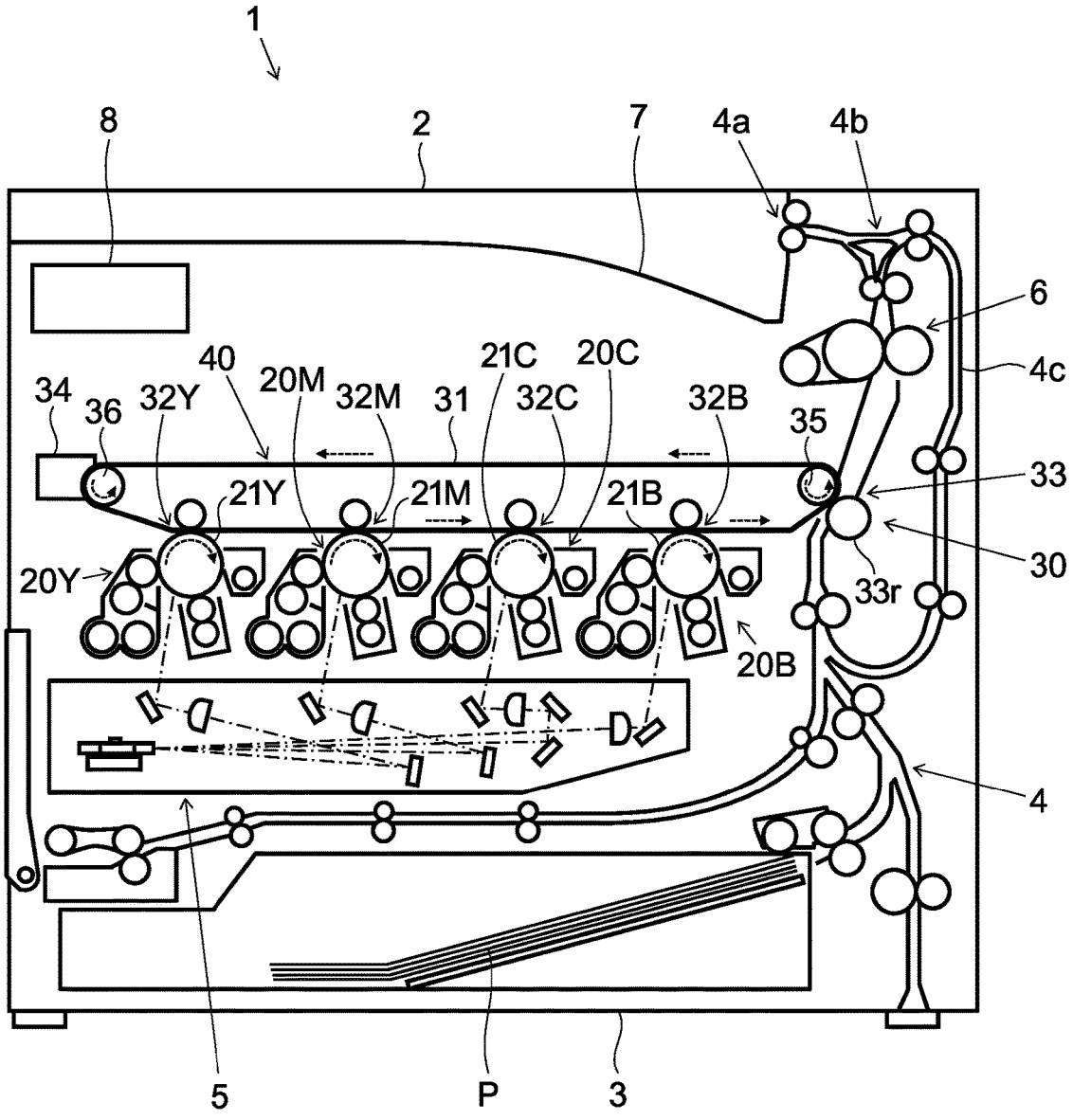
FIG. 1 is a schematic sectional front view showing a configuration of an image forming apparatus according to an embodiment of the present disclosure.
Figure 2:
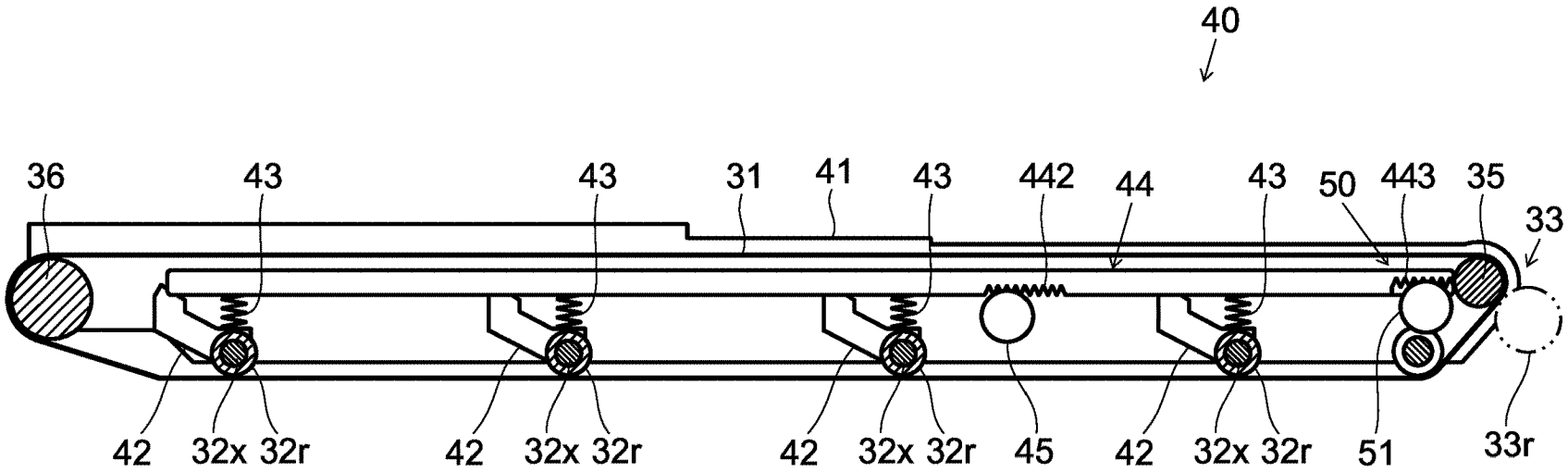
FIG. 2 is a sectional front view showing an intermediate transfer device of the image forming apparatus in FIG. 1.

FIG. 1 is a schematic sectional front view showing a configuration of an image forming apparatus 1 according to the embodiment. FIG. 2 is a sectional front view showing an intermediate transfer device 40 of the image forming apparatus 1 in FIG. 1. One example of the image forming apparatus 1 according to this embodiment is a tandem-type color printer that uses an intermediate transfer belt 31 to transfer a toner image to a sheet P. The image forming apparatus 1 may be a so-called multi-functional peripheral equipped with functions of, for example, printing, scanning (image reading), and facsimile transmission.

As shown in FIG. 1 and FIG. 2, the image forming apparatus 1 includes, in a main body 2 thereof, a paper feed unit 3, a sheet conveyance unit 4, an exposure unit 5, an image forming portion 20, a transfer unit 30, a fixing unit 6, a sheet discharge unit 7, and a control unit 8.

The paper feed unit 3 contains a plurality of sheets S and feeds out the sheets (recording media) S one by one separately during printing. The sheet conveyance unit 4 conveys the sheet S fed out from the paper feed unit 3 to a secondary transfer portion 33 and to the fixing unit 6 and further discharges the sheet S that has been subjected to fixing to the sheet discharge unit 7 through a sheet discharge port 4*a*. In a case of performing double-sided printing, the sheet conveyance unit 4 uses a branch portion 4*b* to sort the sheet S whose first side has been subjected to fixing into a reverse conveyance portion 4*c* so that the sheet S is conveyed again to the secondary transfer portion 33 and to the fixing unit 6. The exposure unit 5 applies laser light controlled based on image data toward the image forming portion 20.

The image forming portion 20 is disposed below the intermediate transfer belt 31. The image forming portion 20 includes an image forming portion 20Y for forming a yellow image, an image forming portion 20M for forming a magenta image, an image forming portion 20C for forming a cyan image, and an image forming portion 20B for forming a black image. The four image forming portions 20 are identical in basic configuration. For this reason, in the following description, unless particularly required to be limited, identification symbols "Y," "M," "C," and "B" representing the respective colors may be omitted.

As shown in FIG. 1, the image forming portion 20 includes a photosensitive drum (image carrier) 21 that is supported so as to be rotatable in a prescribed direction (clockwise in FIG. 1). The photosensitive drum 21 is disposed so that a rotation axis thereof lies horizontally. The image forming portion 20 further includes, around the photosensitive drum 21, a charging portion, a developing portion, and a drum cleaning portion, which are disposed along a rotation direction of the photosensitive drum 21. A primary transfer portion 32 is disposed between the developing portion and the drum cleaning portion.

The photosensitive drum 21 has a photosensitive layer on an outer circumferential surface thereof. The charging portion charges the outer circumferential surface of the photosensitive drum 21 to a prescribed potential. The exposure unit 5 exposes to light the outer circumferential surface of the photosensitive drum 21 that has been charged by the charging portion so that an electrostatic latent image of an original document image is formed on the outer circumferential surface of the photosensitive drum 21. The developing portion causes toner to adhere to the electrostatic latent image so as to develop the electrostatic latent image into a toner image. The four image forming portions 20 form toner images of the different colors, respectively. After the toner image has been primarily transferred to an outer circumferential surface of the intermediate transfer belt 31, the drum cleaning portion performs cleaning to remove residual toner or the like remaining on the outer circumferential surface of the photosensitive drum 21.

As shown in FIG. 1, the transfer unit 30 includes the intermediate transfer belt 31, primary transfer portions 32Y, 32M, 32C, and 32B, the secondary transfer portion 33, and a belt cleaning portion 34. The intermediate transfer belt 31 is disposed above the four image forming portions 20. The intermediate transfer belt 31 is supported so as to be rotatable in a prescribed direction (counterclockwise in FIG. 1) and is an intermediate transfer body on which toner images formed respectively in the four image forming portions 20 are primarily transferred sequentially in a superimposed manner. The four image forming portions 20 are disposed in so-called tandem alignment, i.e., arranged in line from an upstream side toward a downstream side in a rotation direction of the intermediate transfer belt 31.

The primary transfer portions 32Y, 32M, 32C, and 32B are disposed above the image forming portions 20Y, 20M, 20C, and 20B of the respective colors, respectively, via the intermediate transfer belt 31. The secondary transfer portion 33 is disposed, in the sheet conveyance unit 4, on an upstream side of the fixing unit 6 in a sheet conveyance direction and, in the transfer unit 30, on a downstream side of the image forming portions 20Y, 20M, 20C, and 20B of the respective colors in the rotation direction of the intermediate transfer belt 31. The belt cleaning portion 34 is disposed, for example, on an upstream side of the image forming portions 20Y, 20M, 20C, and 20B of the respective colors in the rotation direction of the intermediate transfer belt 31.

In the primary transfer portions 32Y, 32M, 32C, and 32B of the respective colors, toner images are primarily transferred to the outer circumferential surface of the intermediate transfer belt 31. Further, as the intermediate transfer belt 31 rotates, at prescribed timing, toner images in the four image forming portions 20 are successively transferred in a superimposed manner to the intermediate transfer belt 31, and thus on the outer circumferential surface of the intermediate transfer belt 31, the toner images of the four different colors of yellow, cyan, magenta, and black are superimposed into a color toner image.

The color toner image on the outer circumferential surface of the intermediate transfer belt 31 is transferred, at a secondary transfer nip formed in the secondary transfer portion 33, to the sheet S timely conveyed thereto by the sheet conveyance unit 4. After the secondary transfer, the belt cleaning portion 34 performs cleaning to remove residual toner or the like remaining on the outer circumferential surface of the intermediate transfer belt 31.

The fixing unit 6 is disposed, in the sheet conveyance unit 4, on a downstream side of the secondary transfer portion 33 in the sheet conveyance direction and above the secondary transfer portion 33. The fixing unit 6 heats and presses the sheet S on which the toner image has been transferred so as to fix the toner image to the sheet S.

The sheet discharge unit 7 is disposed above the transfer unit 30. The sheet S on which the toner image has been fixed to complete printing thereof is conveyed to the sheet discharge unit 7.

The control unit 8 includes a CPU, an image processing portion, a storage portion, and other electronic circuits and electronic components (none of these are shown). Based on control programs and data stored in the storage portion, the CPU controls operations of the various constituent elements provided in the image forming apparatus 1 so as to perform processes related to functions of the image forming apparatus 1. The paper feed unit 3, the sheet conveyance unit 4, the exposure unit 5, the image forming portion 20, the transfer unit 30, and the fixing unit 6 individually receive instructions from the control unit 8 to perform printing on the sheet S in tandem with each other. The storage portion is composed of, for example, a combination of a nonvolatile storage device such as a program ROM (read-only memory) or a data ROM and a volatile storage device such as a RAM (random-access memory).

Next, a detailed description is given of a configuration of the transfer unit 30. The transfer unit 30 includes an intermediate transfer device 40 shown in FIG. 1 and FIG. 2. FIG. 2 is a sectional front view showing the intermediate transfer device 40 of the image forming apparatus 1 in FIG. 1. In this embodiment, a width direction of the intermediate transfer belt 31 orthogonal to a moving direction thereof extends parallel to a front-rear direction of the image forming apparatus 1 (a depth direction of planes of FIG. 1 and FIG. 2). FIG. 2 is a sectional front view of the intermediate transfer device 40 as viewed rearward from an intermediate part of the intermediate transfer belt 31 in the width direction thereof.

The intermediate transfer device 40 includes a pair of frame members 41, the intermediate transfer belt 31, a plurality of support rollers, and four primary transfer rollers 32*r*.

The pair of frame members 41 is disposed on a front-side side surface and a rear-side side surface of the intermediate transfer device 40. The pair of frame member 41 extends along an up-down direction and the moving direction of the intermediate transfer belt 31. The pair of frame members 41 rotatably supports the plurality of support rollers and four primary transfer rollers 32*r*.

The intermediate transfer belt 31 is disposed along the four image forming portions 20. The intermediate transfer belt 31 is endless and is rotatably supported by the plurality of support rollers. The intermediate transfer belt 31 moves along an arrangement direction of the four photosensitive drums 21.

The plurality of support rollers include a driving roller 35 and a driven roller 36 in this embodiment.

The driving roller 35 is disposed on a downstream side of the image forming portions 20Y, 20M, 20C, and 20B of the respective colors in the rotation direction of the intermediate transfer belt 31. The driving roller 35 receives power from an unshown drive motor and uses it to cause the intermediate transfer belt 31 to rotate counterclockwise in FIG. 2.

The driving roller 35 is disposed adjacently to the secondary transfer portion 33. A secondary transfer roller 33*r* is disposed in the secondary transfer portion 33. The secondary transfer roller 33*r* is disposed at such a position as to be opposed to the driving roller 35 via the intermediate transfer belt 31 and is in contact with the outer circumferential surface of the intermediate transfer belt 31.

The driven roller 36 is disposed on an upstream side of the image forming portions 20Y, 20M, 20C, and 20B of the respective colors in the rotation direction of the intermediate transfer belt 31. As the intermediate transfer belt 31 rotates, the driven roller 36 rotates counterclockwise in FIG. 2. The driven roller 36 is biased by a spring (not shown) in a direction away from the driving roller 35. Thus, a prescribed tension is applied to the intermediate transfer belt 31.

The four primary transfer rollers 32*r* are disposed above the four image forming portions 20, respectively, via the intermediate transfer belt 31. Each of the primary transfer rollers 32*r* is disposed to be opposed to the photosensitive drum 21 via the intermediate transfer belt 31 and is in contact with an inner circumferential surface of the intermediate transfer belt 31. The primary transfer rollers 32*r* transfer, onto the intermediate transfer belt 31, toner images formed on the outer circumferential surfaces of the four photosensitive drums 21, respectively, by sequentially superimposing them on each other.

Figure 3:
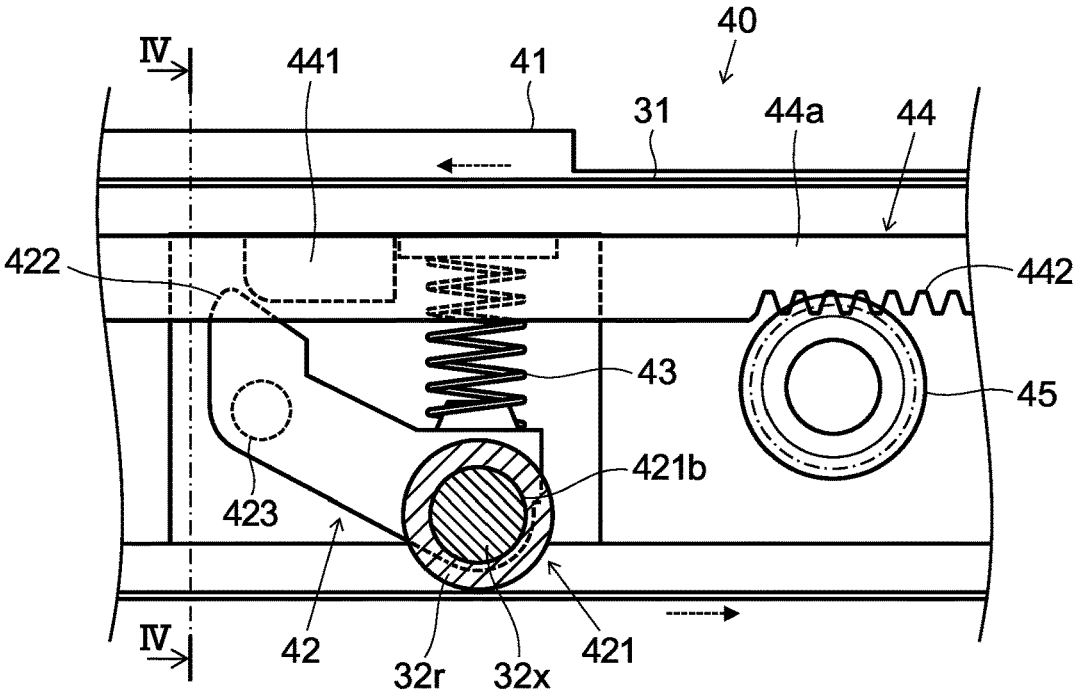
FIG. 3 is a partial sectional front view showing a vicinity of a support member for a primary transfer roller of the intermediate transfer device in FIG. 2.
Figure 4:
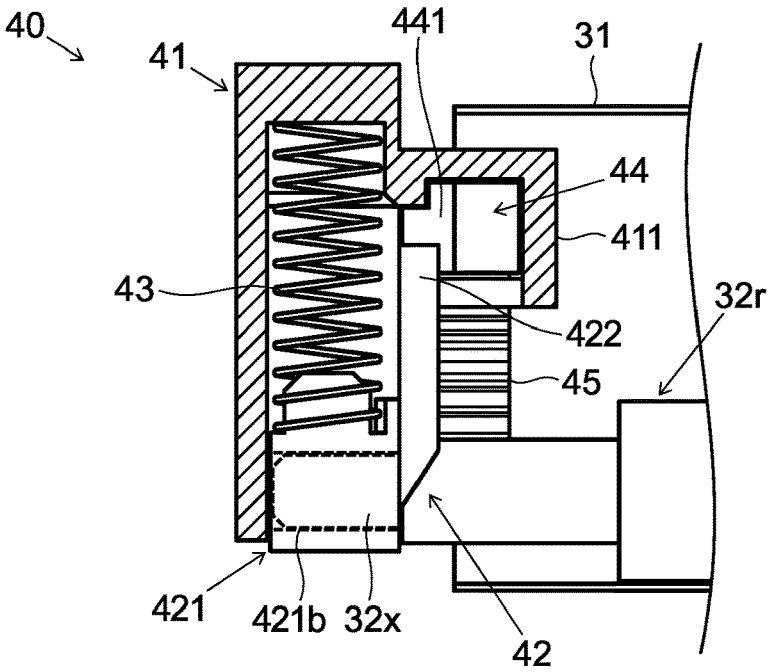
FIG. 4 is a partial sectional side view showing the vicinity of the support member for the primary transfer roller of the intermediate transfer device in FIG. 3.
Figure 5:
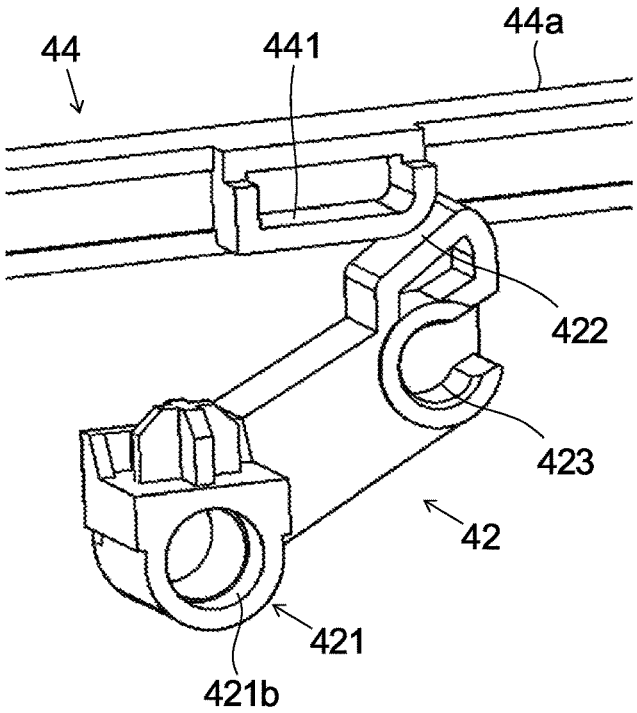
FIG. 5 is a perspective view showing the support member for the primary transfer roller and a movable member of the intermediate transfer device in FIG. 3.
Figure 6:
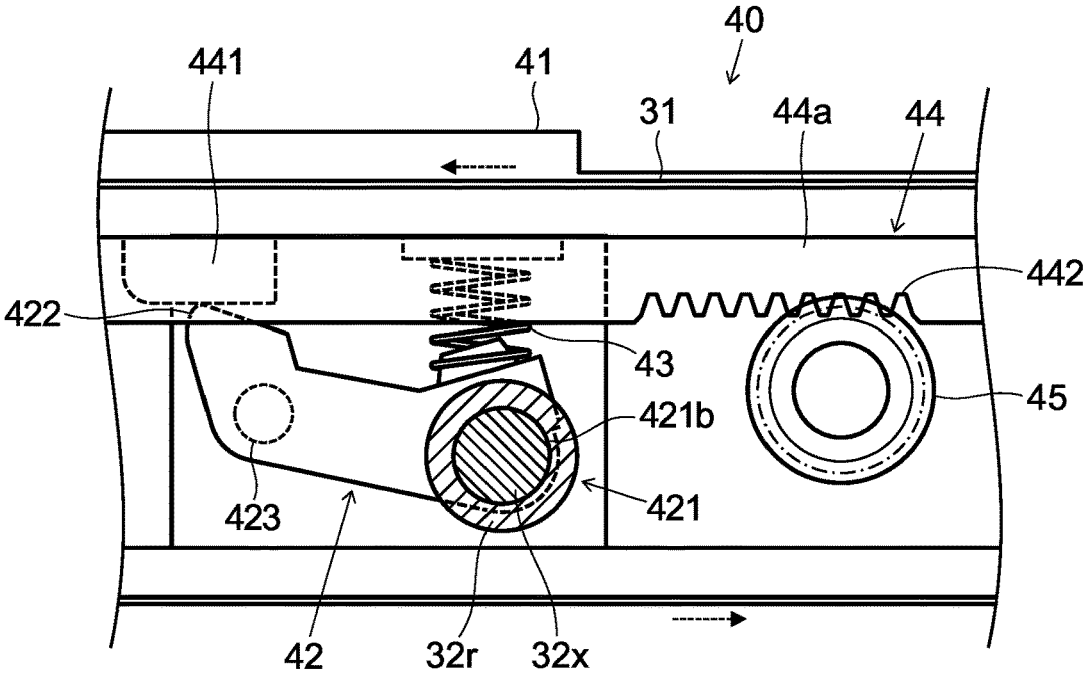
FIG. 6 is a partial sectional front view showing the vicinity of the support member for the primary transfer roller of the intermediate transfer device in FIG. 2 in a state where the movable member has been moved.
Figure 7:
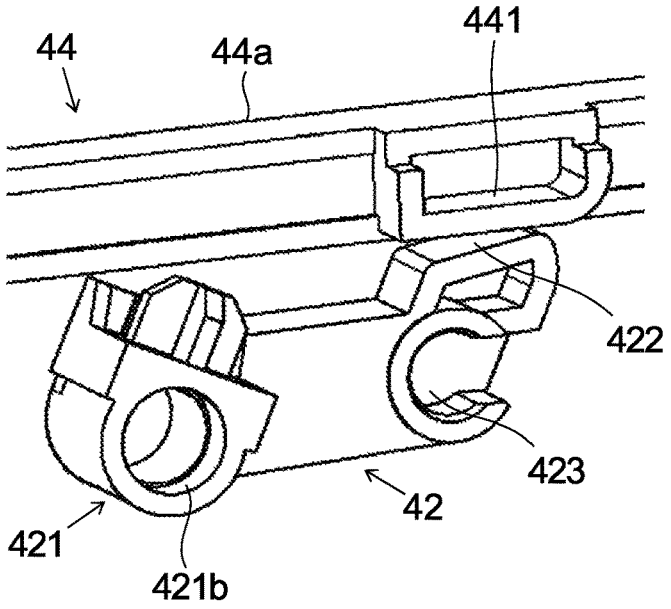
FIG. 7 is a perspective view showing the support member for the primary transfer roller and the movable member of the intermediate transfer device in FIG. 6.

Next, a description is given of a detailed configuration of the intermediate transfer device 40. FIG. 3 is a partial sectional front view showing a vicinity of a support member for each of the primary transfer rollers 32*r* of the intermediate transfer device 40 in FIG. 2. FIG. 4 is a partial sectional side view showing the vicinity of the support member for each of the primary transfer rollers 32*r* of the intermediate transfer device 40 in FIG. 3. FIG. 5 is a perspective view showing the support member for each of the primary transfer rollers 32*r* and a movable member of the intermediate transfer device 40 in FIG. 3. FIG. 6 is a partial sectional front view showing the vicinity of the support member for each of the primary transfer rollers 32*r* of the intermediate transfer device 40 in FIG. 2 in a state where the movable member has been moved. FIG. 7 is a perspective view showing the support member for each of the primary transfer rollers 32*r* and the movable member of the intermediate transfer device 40 in FIG. 6.

The intermediate transfer device 40 includes a support member 42, a biasing member 43, a pair of movable members 44, and a drive gear 45. The support member 42, the biasing member 43, each of the movable members 44, and the drive gear 45 are mounted to each of the pair of frame members 41 disposed on the front-side side surface and the rear-side side surface of the intermediate transfer device 40.

The support member 42 is mounted to a lower part of each of the frame members 41. The support member 42 extends in the moving direction of the intermediate transfer belt 31, namely, a direction intersecting with a rotation axis of the primary transfer rollers 32*r*. The support member 42 includes a support portion 421, a to-be-contacted portion 422, and a pivot shaft portion 423, which are disposed along a longitudinal direction (extending direction) thereof.

The support portion 421 is provided on one end side of the support member 42 in the longitudinal direction thereof. In other words, in this embodiment, the support portion 421 is provided at a downstream end part with respect to the moving direction of the intermediate transfer belt 31 at a location on the intermediate transfer belt 31 to which each of the primary transfer rollers 32*r* is opposed. The support portion 421 supports each of the primary transfer rollers 32*r*. Specifically, the support portion 421 has a bearing 421*b* that rotatably supports each of both end parts of a rotary shaft 32*x* of each of the primary transfer rollers 32*r*. When a toner image is primarily transferred to the intermediate transfer belt 31, the support portion 421 is at a position where each of the primary transfer rollers 32*r* is in contact with the inner circumferential surface of the intermediate transfer belt 31.

The to-be-contacted portion 422 is provided on the other end side of the support member 42 in the longitudinal direction thereof. In other words, in this embodiment, the to-be-contacted portion 422 is provided at an upstream end part with respect to the moving direction of the intermediate transfer belt 31 at a location on the intermediate transfer belt 31 to which each of the primary transfer rollers 32*r* is opposed. Each of the movable members 44 makes contact with the to-be-contacted portion 422. When a toner image is primarily transferred to the intermediate transfer belt 31, the to-be-contacted portion 422 is positioned on an upper side beyond the support portion 421 and on a movement path of an after-mentioned contact piece 441 of each of the movable members 44.

In the longitudinal direction of the support member 42, the pivot shaft portion 423 is provided between the support portion 421 and the to-be-contacted portion 422. The pivot shaft portion 423 extends along an axis direction of each of the primary transfer rollers 32*r*. The support member 42 is pivotably supported to each of the frame members 41 via the pivot shaft portion 423. The support member 42 pivots about the pivot shaft portion 423, and thus the support portion 421 and the to-be-contacted portion 422 move in the up-down direction.

That is, the support member 42 is pivotable in directions in which each of the primary transfer rollers 32*r* approaches and separates from the intermediate transfer belt 31. That is, the pair of frame members 41 is disposed at the both end parts of the rotary shaft 32*x* of each of the four primary transfer rollers 32*r* and pivotably supports the support member 42.

The biasing member 43 is disposed on an upper side of the support portion 421. An upper end of the biasing member 43 is in contact with each of the frame members 41, and a lower end of the biasing member 43 is in contact with an upper side of the bearing 421*b* of the support portion 421. The biasing member 43 is formed of, for example, a compression coil spring and biases the support portion 421 of the support member 42 downward. That is, the biasing member 43 biases the support member 42 in the direction in which each of the primary transfer rollers 32*r* approaches the intermediate transfer belt 31.

The movable members 44 are mounted to upper parts of the frame members 41, respectively. The movable members 44 extend along the moving direction of the intermediate transfer belt 31. The movable members 44 are each formed in an elongated rod shape extending from near the secondary transfer portion 33 to an upper side of the primary transfer portion 32Y for transferring a yellow image most distant from the secondary transfer portion 33.

Each of the frame members 41 includes a movable member housing portion 411 for supporting a corresponding one of the movable members 44. The movable members 44 are supported to the frame members 41, respectively, so as to be reciprocatable along the moving direction of the intermediate transfer belt 31.

Each of the movable members 44 includes the contact piece 441. The contact piece 441 protrudes in a rotation axis direction of the primary transfer rollers 32*r* (a far side in a depth direction of a plane of FIG. 3, a left side in a left-right transverse direction in FIG. 4) from a main body portion 44*a* of each of the movable members 44 extending along the moving direction of the intermediate transfer belt 31. The contact piece 441 is positioned on a movement path of the to-be-contacted portion 422 of the support member 42.

In a case where each of the primary transfer rollers 32*r* is at a primary transfer position where it is in contact with the inner circumferential surface of the intermediate transfer belt 31, when the movable members 44 move along the moving direction of the intermediate transfer belt 31, the contact piece 441 makes contact with the to-be-contacted portion 422 of the support member 42. As shown in FIG. 6 and FIG. 7, this causes the support member 42 to pivot about the pivot shaft portion 423 against a biasing force of the biasing member 43. The primary transfer rollers 32*r* separate from the inner circumferential surface of the intermediate transfer belt 31. Each of the movable members 44 causes the support member 42 to pivot in this manner.

As shown in FIG. 4, in the rotation axis direction of the primary transfer rollers 32*r*, the movable members 44 are disposed between the pair of frame members 41 and within an extending range of the intermediate transfer belt 31. According to this configuration, in the width direction of the intermediate transfer belt 31, the movable members 44 are not positioned outside the extending range of the intermediate transfer belt 31. That is, part of constituent elements of a mechanism for causing the primary transfer rollers 32*r* to approach and separate from the intermediate transfer belt 31 can be housed within the extending range of the intermediate transfer belt 31. Accordingly, it is possible to achieve size reduction of the intermediate transfer device 40 and the image forming apparatus 1.

The drive gear 45 is disposed on a lower side of each of the movable members 44 and, for example, between two of the primary transfer rollers 32*r* in the moving direction of the intermediate transfer belt 31. The drive gear 45 is rotatable about a rotation axis extending parallel to the rotation axis of the primary transfer rollers 32*r*. Each of the movable members 44 includes a drive rack 442. The drive rack 442 has a plurality of teeth juxtaposed in the moving direction of the intermediate transfer belt 31, and the drive gear 45 meshes therewith.

The drive gear 45 receives power from a drive source (not shown) of the intermediate transfer device 40 and thus is caused to rotate in both normal and reverse directions. The drive gear 45 rotates in both the normal and reverse directions, thus enabling each of the movable members 44 to reciprocate along the moving direction of the intermediate transfer belt 31.

Each of the movable members 44 is caused to reciprocate along the moving direction of the intermediate transfer belt 31, and thus the contact piece 441 makes contact with or separates from the to-be-contacted portion 422 of the support member 42. The intermediate transfer device 40 causes the support member 42 to pivot between a separation position where the contact piece 441 makes contact with the to-be-contacted portion 422 so that the primary transfer rollers 32*r* separate from the intermediate transfer belt 31 against a biasing force of the biasing member 43 and a contact position where the contact piece 441 separates from the to-be-contacted portion 422 so that the primary transfer rollers 32*r* make contact with the intermediate transfer belt 31 under the biasing force of the biasing member 43. According to this configuration, the primary transfer rollers 32*r* can be easily caused to approach and separate from the intermediate transfer belt 31 by the movable members 44 housed within the extending range of the intermediate transfer belt 31.

Furthermore, as shown in FIG. 2, the intermediate transfer device 40 includes an approach/separation mechanism 50 for the secondary transfer roller 33*r*. The approach/separation mechanism 50 is provided in proximity to the secondary transfer roller 33*r* that transfers a toner image on the intermediate transfer belt 31 to the sheet S.

Figure 8:
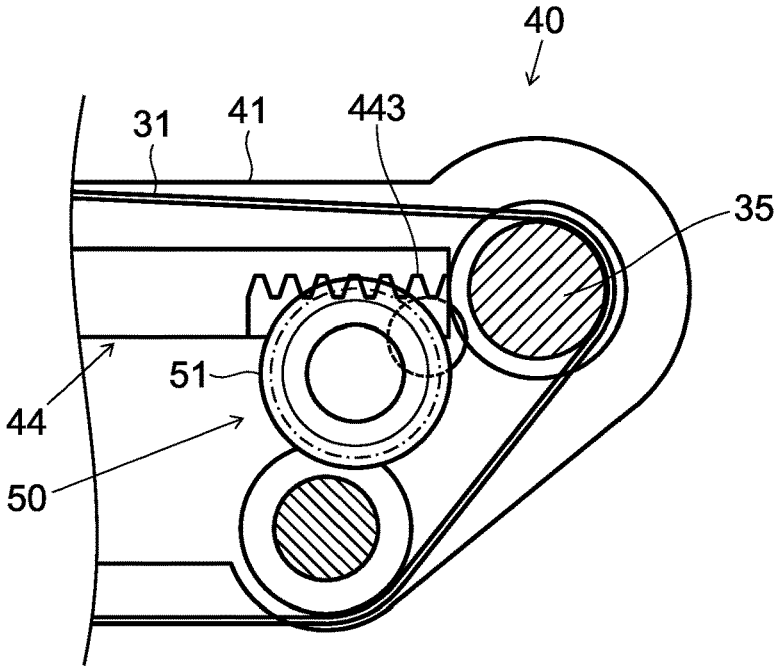
FIG. 8 is a partial sectional front view showing a vicinity of an approach/separation mechanism for a secondary transfer roller in the intermediate transfer device in FIG. 2.
Figure 9:
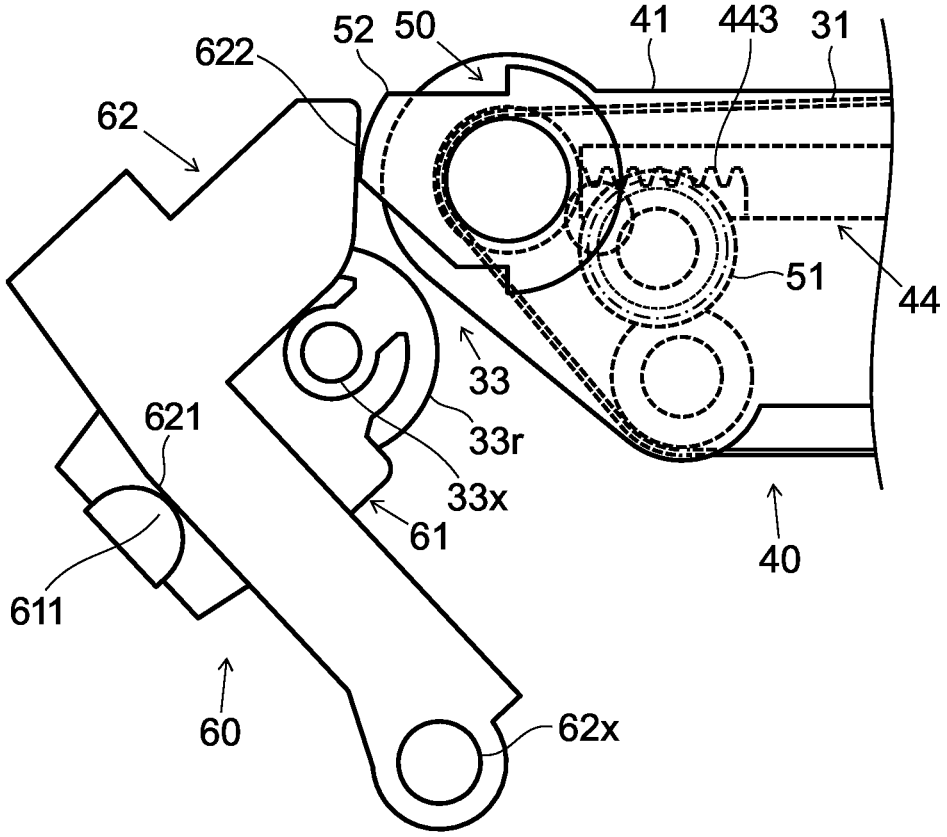
FIG. 9 is a rear view showing the approach/separation mechanism for the secondary transfer roller in the intermediate transfer device in FIG. 8 and a vicinity of the secondary transfer roller.

FIG. 8 is a partial sectional front view showing a vicinity of the approach/separation mechanism 50 for the secondary transfer roller 33*r* in the intermediate transfer device 40 in FIG. 2. FIG. 9 is a rear view showing the approach/separation mechanism 50 for the secondary transfer roller 33*r* in the intermediate transfer device 40 in FIG. 8 and a vicinity of the secondary transfer roller 33*r*.

Each of the movable members 44 includes an approach/separation rack 443. The approach/separation rack 443 is provided at an end part of each of the movable members 44 near the secondary transfer portion 33. The approach/separation rack 443 has a plurality of teeth juxtaposed in the moving direction of the intermediate transfer belt 31, and an after-mentioned approach/separation gear 51 meshes therewith.

The approach/separation mechanism 50 includes the approach/separation gear 51 and an approach/separation member 52.

The approach/separation gear 51 is disposed on a lower side of each of the movable members 44 and in proximity to the driving roller 35. The approach/separation gear 51 is rotatable about a rotation axis extending parallel to a rotation axis of the secondary transfer roller 33*r*. The approach/separation gear 51 meshes with the approach/separation rack 443 of each of the movable members 44. Each of the movable members 44 reciprocates along the moving direction of the intermediate transfer belt 31, thus enabling the approach/separation gear 51 to rotate in both normal and revere directions.

As shown in FIG. 9, the approach/separation member 52 is a cam member that is rotatable about a rotation axis extending parallel to the rotation axis of the secondary transfer roller 33*r*. The approach/separation member 52 is connected to the approach/separation gear 51 and rotates as the approach/separation gear 51 rotates. An approach/separation mechanism contact portion 622 of an arm 62 of an after-mentioned pivot mechanism 60 of the secondary transfer roller 33*r* is in contact with a circumferential edge of the approach/separation member 52.

The image forming apparatus 1 includes the pivot mechanism 60 of the secondary transfer roller 33*r*. The pivot mechanism 60 includes a holder 61 and the arm 62.

The holder 61 rotatably supports both end parts of a rotary shaft 33*x* of the secondary transfer roller 33*r*. The holder 61 is movable in directions in which the secondary transfer roller 33*r* makes contact with or separates from the intermediate transfer belt 31. The holder 61 is biased by a biasing member (not shown) in a direction in which the secondary transfer roller 33*r* approaches the intermediate transfer belt 31. The holder 61 has a contact point 611. The arm 62 is in contact with the contact point 611 from a direction opposite to a biasing direction of the biasing member (not shown).

The arm 62 is disposed adjacently to the holder 61 and the approach/separation mechanism 50. The arm 62 extends substantially in the up-down direction. The arm 62 includes a rotary shaft portion 62*x* provided at a lower end part thereof. The arm 62 is rotatably supported to the main body 2 via the rotary shaft portion 62*x* extending parallel to the rotary shaft 33*x* of the second transfer roller 33*r*. The arm 62 includes a holder contact portion 621 and the approach/separation mechanism contact portion 622 that are provided on an upper side beyond the rotary shaft portion 62*x*.

In an up-down direction of the arm 62, the holder contact portion 621 is disposed between the approach/separation mechanism contact portion 622 and the rotary shaft portion 62*x*. The holder contact portion 621 is in contact with the contact point 611 of the holder 61 from the direction opposite to the direction in which the holder 61 is biased by the biasing member (not shown) of the holder 61.

The approach/separation mechanism contact portion 622 is disposed at an upper end part of the arm 62. The approach/separation contact mechanism portion 622 protrudes toward the approach/separation mechanism 50. The approach/separation mechanism contact portion 622 is in contact with the circumferential edge of the approach/separation member 52 of the approach/separation mechanism 50.

For example, when the approach/separation member 52 of the approach/separation mechanism 50 rotates in the normal direction, the arm 62 being in contact with the approach/separation member 52 pivots in the direction in which the secondary transfer roller 33*r* separates from the intermediate transfer belt 31 against the biasing force of the biasing member (not shown) of the holder 61. Furthermore, for example, when the approach/separation member 52 of the approach/separation mechanism 50 rotates in the reverse direction, the arm 62 being in contact with the approach/separation member 52 pivots in the direction in which the secondary transfer roller 33*r* approaches the intermediate transfer belt 31 under the biasing force of the biasing member (not shown) of the holder 61.

As described above, the approach/separation mechanism 50 includes the approach/separation member 52 that causes the secondary transfer roller 33*r* to move in such directions as to approach and separate from the intermediate transfer belt 31. Further, each of the movable members 44 makes contact with the approach/separation mechanism 50 so as to drive the approach/separation member 52. According to this configuration, part of constituent elements of a mechanism for causing the secondary transfer roller 33*r* to approach and separate from the intermediate transfer belt 31 can be housed within the extending range of the intermediate transfer belt 31. Accordingly, it is possible to achieve size reduction of the intermediate transfer device 40 and the image forming apparatus 1.

Furthermore, since the approach/separation rack 443 is provided in each of the movable members 44 and the approach/separation gear 51 and the approach/separation member 52 are provided in the approach/separation mechanism 50, the secondary transfer roller 33*r* can be easily caused to approach and separate from the intermediate transfer belt 31 by the movable members 44 housed within the extending range of the intermediate transfer belt 31.

While the foregoing has described the embodiment of the present disclosure, the scope of the present disclosure is not limited thereto, and the present disclosure can be implemented by adding various modifications thereto without departing from the spirit of the disclosure.

What is claimed is:

1. An intermediate transfer device, comprising:

an endless intermediate transfer belt that moves along an arrangement direction of a plurality of image carriers;

a plurality of primary transfer rollers that are disposed to be opposed to the plurality of image carriers via the intermediate transfer belt and transfer toner images formed on respective outer circumferential surfaces of the plurality of image carriers sequentially in a superimposed manner onto the intermediate transfer belt;

a plurality of pairs of support members that rotatably support both end parts of respective rotary shafts of the plurality of primary transfer rollers and are pivotable in directions in which the primary transfer rollers approach and separate from the intermediate transfer belt;

a biasing member that biases each of the support members in the direction in which the primary transfer rollers approach the intermediate transfer belt;

a pair of movable members that makes contact with the support members on both end sides of the rotary shafts of the plurality of primary transfer rollers so as to cause the support members to pivot; and a pair of frame members that is disposed at the both end parts of the rotary shafts of the plurality of primary transfer rollers and pivotably supports the support members, wherein in a rotation axis direction of the primary transfer rollers, the movable members are disposed between the pair of frame members and within an extending range of the intermediate transfer belt.

2. The intermediate transfer device according to claim 1, wherein the support members extend in a direction intersecting with a rotation axis of the primary transfer rollers, each of the support members includes:

a support portion that is provided on one end side of the each of the support members in a longitudinal direction thereof and supports each of the primary transfer rollers;

a to-be-contacted portion that is provided on another end side of the each of the support members in the longitudinal direction and with which each of the movable members makes contact; and a pivot shaft portion that is provided between the support portion and the to-be-contacted portion in the longitudinal direction and is pivotably supported to each of the frame members, each of the movable members extends in a moving direction of the intermediate transfer belt, each of the movable members includes a contact piece that protrudes in the rotation axis direction of the primary transfer rollers, and the movable members are caused to reciprocate along the moving direction of the intermediate transfer belt, and thus each of the support members is caused to pivot between a separation position where the contact piece makes contact with the to-be-contacted portion so that the primary transfer rollers separate from the intermediate transfer belt against a biasing force of the biasing member and a contact position where the contact piece separates from the to-be-contacted portion so that the primary transfer rollers make contact with the intermediate transfer belt under the biasing force of the biasing member.

3. The intermediate transfer device according to claim 1, further comprising:

an approach/separation mechanism that is provided in proximity to a secondary transfer roller configured to transfer the toner images on the intermediate transfer belt to a recording medium, the approach/separation mechanism including an approach/separation member that causes the secondary transfer roller to approach and separate from the intermediate transfer belt, and each of the movable members makes contact with the approach/separation mechanism so as to drive the approach/separation member.

4. The intermediate transfer device according to claim 3, wherein each of the movable members includes an approach/separation rack that is provided adjacently to the approach/separation mechanism and has a plurality of teeth juxtaposed in a moving direction of the intermediate transfer belt, the approach/separation mechanism includes:

an approach/separation gear that meshes with the approach/separation rack, and the approach/separation member that rotates as the approach/separation gear rotates and causes the secondary transfer roller to approach/separate from the intermediate transfer belt.

5. An image forming apparatus comprising the intermediate transfer device according to claim 1.

* * * * *